United States Patent [19]

Haven et al.

[11] 4,408,946

[45] Oct. 11, 1983

[54] DUMPING HOPPER

[76] Inventors: James T. Haven; Warren G. Haven, both of 537 N. Clark St., Orange, Calif. 92668

[21] Appl. No.: 176,675

[22] Filed: Aug. 11, 1980

[51] Int. Cl.[3] ..... B66F 9/19

[52] U.S. Cl. ..... 414/424; 414/403; 414/404; 414/422

[58] Field of Search ..... 414/403, 422, 424, 425, 414/404, 420, 639, 642, 652, 653

[56] References Cited

U.S. PATENT DOCUMENTS

| | | | |
|---|---|---|---|
| 2,705,571 | 4/1955 | Streb et al. | 414/420 |
| 2,816,673 | 12/1957 | Chapman, Jr. | 414/424 |
| 3,006,490 | 10/1961 | Dempster et al. | 414/424 |
| 3,307,724 | 3/1967 | Miller | 414/420 |
| 3,613,924 | 10/1971 | Monson | 414/420 |
| 3,719,296 | 3/1973 | Larson, Jr. | 414/422 |
| 3,966,068 | 6/1976 | Duvia | 414/424 |
| 3,984,017 | 10/1976 | Giles | 414/420 |
| 4,286,913 | 9/1981 | Rowe et al. | 414/642 |

*Primary Examiner*—Trygve M. Blix
*Assistant Examiner*—C. T. Bartz
*Attorney, Agent, or Firm*—Fischer, Tachner & Strauss

[57] ABSTRACT

The application discloses a design for an automatically dumping hopper for use with a forklift. The hopper is designed for a 1-man operation with the operator transporting stacking and dumping the hopper without leaving the forklift seat and without the use of any controls other than the controls of the forklift. Two embodiments of the invention are disclosed. One embodiment which is useful for sand, gravel and other loose bulk material has a hinged bottom secured to the sidewalls with a hasp latch constructed such that when the hopper is tilted on edge, the hasp clears from its retainer, releasing the bottom to open when the hopper is lifted. The latch only releases upon tilting of the hopper so that the hopper can be transported and stored when lifted vertically. The second embodiment, which is useful as a hopper for trash or other loose bulk material, has a pivotally mounted hopper on a base with an inclined front wall and a bracket that hooks onto a receiving box, permitting the operator to partially withdraw the fork of the lift fork, releasing the pivoted end of the hopper so that raising the fork will tip the hopper, dumping its contents into the receiving box.

4 Claims, 10 Drawing Figures

DUMPING HOPPER

BACKGROUND OF THE INVENTION

Sand, gravel and other loose granular bulk material is difficult to transport and deliver using conventional equipment. Sand hoppers presently in use have a lever actuated latch which requires the forklift operator to dismount to actuate.

Land clearing or landscaping operations commonly use a large, truck size trash hopper which is transported to the work site and which is usually loaded manually or with a front-end loader. It is desireable to provide small, easily transportable trash hoppers which can be moved with a forklift and which can be automatically dumped into the large trash hopper by the forklift operator using only the forklift controls and without the need to dismount from the forklift for dumping of the trash hopper.

BRIEF DESCRIPTION OF THE INVENTION

This invention comprises a dumping hopper design which can be used in combination with a forklift to permit the transporting, stacking and dumping of the hopper by the forklift operator without dismounting from the forklift. The dump hopper useful for loose granular bulk material has vertical side walls fixedly and rigidly interconnected with a top frame member which can receive the fork of a forklift and having a bottom wall hingedly secured along one edge to a bottom edge of the hopper. A latch is provided on the hopper sidewall opposite that having the hinged bottom wall and the latch includes a pivotal hasp which engages a subjacent hasp retainer carried by the bottom wall. The hasp is weighted so that when the hopper is tilted along the latched edge, the hasp pivotally moves out of engagement with its retainer, releasing the bottom wall of the hopper so that when raised, the contents of the hopper are discharged through the open bottom.

The invention also includes a dumping trash hopper which has an inclined front fall and which is pivotally mounted on a subjacent frame having a fore frame and an aft frame pivotally interconnected and adapted to receive the fork of a lift fork. The hopper can be transported and lifted without dumping its contents by full-ing inserting the fork into the hopper frame. The hopper can be positioned with its inclined front wall resting on the large trash box and the operator can partially withdraw the lift to release the fore frame. When the hopper is then lifted, the fore frame pivots, tilting the hopper and discharging its contents into the large box hopper.

BRIEF DESCRIPTION OF THE DRAWINGS

The invention will be described with reference to the figures of which.

DESCRIPTION OF THE PREFERRED EMBODIMENTS

Figure 1:
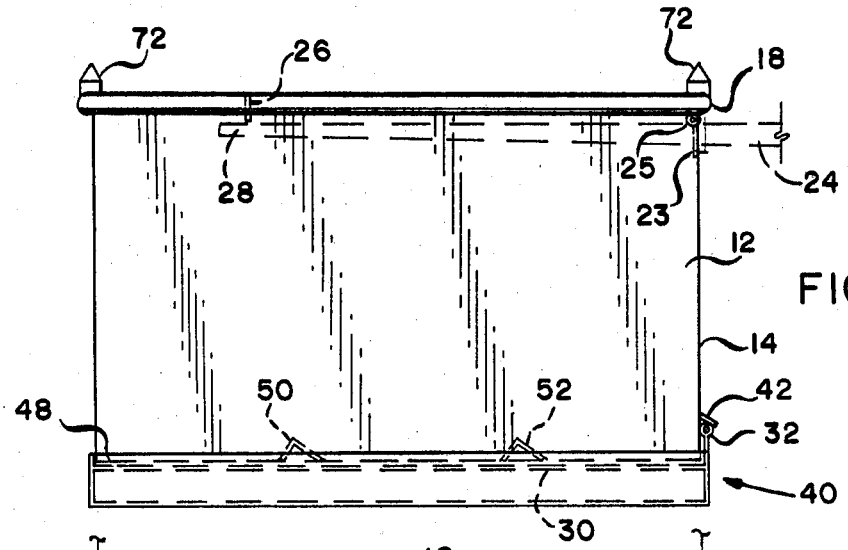
FIGS. 1, 2 and 3 are side, front and back views, respectively of the dumping hopper of the invention.
Figure 2:
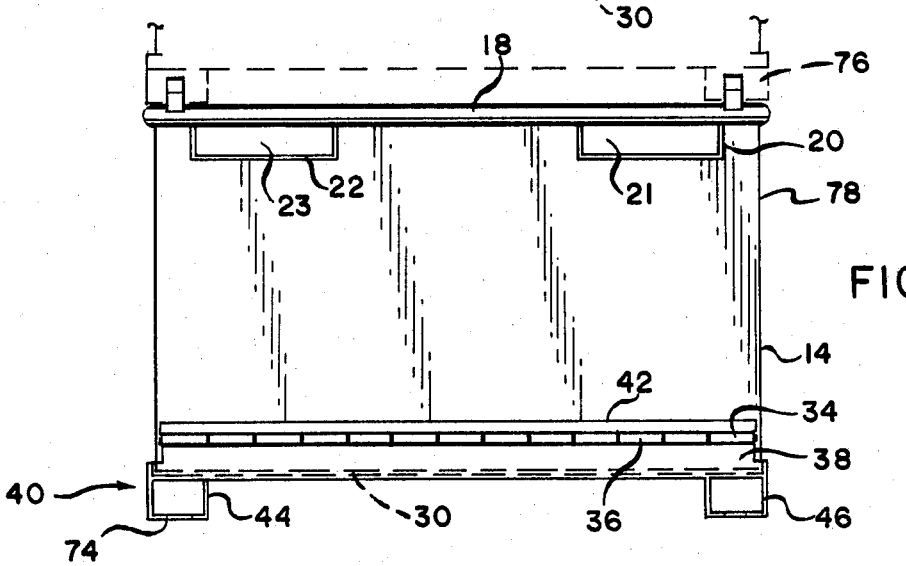
Figure 3:
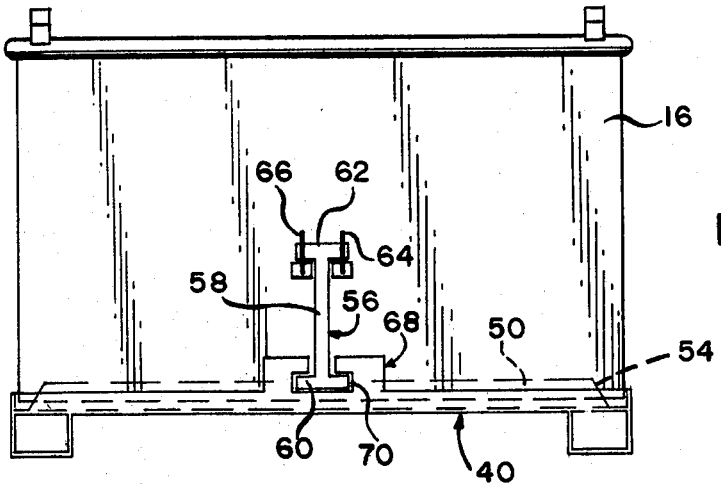

Referring to FIGS. 1–3, the dump hopper of the invention is shown with vertical walls such as side wall 12, rear wall 14 and front wall 16. Four vertical walls are employed forming a generally rectangular or square chamber which is open at its top and has a tubular upper frame 18 extending about its upper peripheral edge. The tubular frame includes receptical brackets 20 and 22 for receiving the fork 24 of a convention forklift. The brackets 20 and 22 are provided with cover plates 21 and 23 which are hinged to the inside top edge of rear wall 14 by hinges 23. The cover plates prevent spilling of material through receptical brackets 20 and 22 and serve to clean off the lift when it is withdrawn. A cross bar 26 can be positioned intermediately of the frame for engagement with the forward end 28 of the lift fork.

The bottom wall 30 of the dump hopper is hingedly connected to the lower edge of rear wall 14 by hinge 32. The latter is a piano type hinge formed with a plurality of short pipe sections such as 34 which are welded to the rear wall 14 and interspaced with like pipe sections 36 which are welded to flange 38 carried by the bottom wall assembly generally indicated at 40. For this purpose, $\frac{3}{4}$ inch diameter pipe sections can be used and the hinge pin can be a $\frac{5}{8}$ inch diameter rod. Preferably, the hinge is covered with a baffle plate 42 to shield the hinge against invasion by debris and the like.

The bottom wall assembly 40 includes the aforementioned bottom wall 30 which is surmounted on opposite and parallel side rails 44 and 46 that are preferably formed of channel members. The bottom wall assembly includes a peripheral upper edge 48 within which is received the lower edges of the hopper side walls. The bottom wall 30 is preferably reinforced by one or more reinforcement ribs 50 and 52 which are preferably of right angle members and which extend laterally across bottom wall 30. The ends of these reinforcement ribs are preferably beveled as shown at 54 in FIG. 3 to serve as alignment guides for proper seating of the sidewalls within the peripheral upper frame of the bottom wall assembly 40.

Referring now to FIG. 3, the latch means of the hopper will be described. As there illustrated, a hasp 56 is pivotally secured to the front wall 16 of the hopper. This hasp is in the form of a T-Bar with a vertical leg 58 and a dependent cross bar 60. At its opposite end, the hasp 56 also has a cross bar 62 which is pivotally secured by strap brackets 64 and 66. The bottom wall assembly 40 has a hasp retainer 68 in the form of an inverted T-Slot 70 to receive cross bar 60 and the end of the vertical bar 58 of hasp 56.

In a preferred embodiment, the hoppers of the invention are provided with indexing pins 72 at two corner's of the upper tubular frame 18. These pins will operate with aligned apertures 74 in the side rails 44 and 46 to permit the aligned or indexed stacking of the hoppers in the manner shown by the phantom line illustration of FIG. 2 wherein a second hopper 76 is superimposed on a lower hopper 78.

Figure 4:
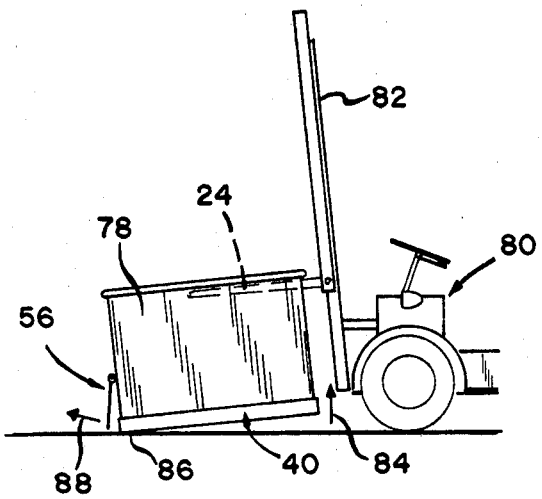
FIGS. 4 and 5 illustrate the dumping operation of the hopper of FIGS. 1–3.
Figure 5:
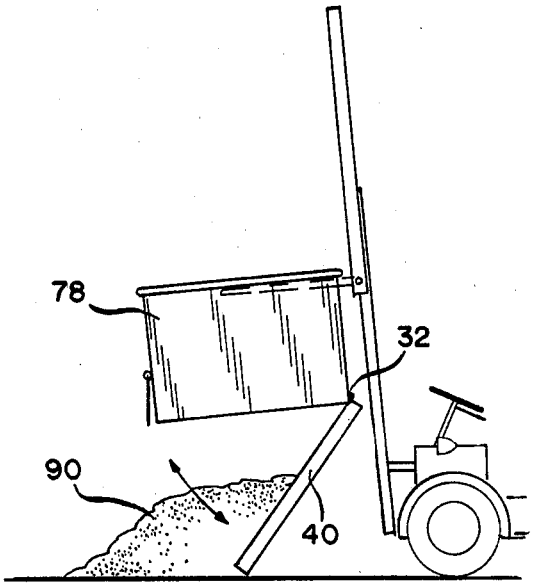

Referring now to FIGS. 4 and 5, the dumping operation of the hopper will be described. In this operation, the fork 24 of a forklift 80 is inserted into the receiving brackets such as 20 and 22 and the forklift operator tilts the vertical standard 82 of the forklift and raises the lift fork on standard 82, raising the rear edge of the hopper as shown by arrowhead line 84, tilting the hopper along its forward edge 86. Since the weight of the hopper remains on the forward edge 86, the hasp 56 is only loosely received in the retaining T-Slot 70 of the bottom wall assembly 40 and the tilting of the hopper in the illustrated manner pemits the hasp 56 to swing, relative to the hopper in the direction indicated by arrowhead line 88, clearing the cross bar 60 of the T-Slot 70 and releasing the bottom wall. The continued elevation of the hopper as shown in FIG. 5 lifts the hopper 78, permitting the bottom wall assembly 40 to pivot about hinge 32 and releasing the solid granular contents 90. The contined elevation of the hopper 78 clears the hopper from the contents. The operator can then back the forklift with its suspended and empty hopper from the pile 90 and, by reversing the sequence of operations, can close the hopper and resecure the hasp, all without dismounting from the forklift.

The hopper described in FIGS. 1 through 3 can be lifted and transported without activating its dumping mechanism simpy by maintaining the standard 82 of the forklift in a vertical position or inclined opposite to that shown in FIGS. 4 and 5, or by lifting the hopper 78 from the bottom with the lift between rails 44 and 46.

Figure 6:
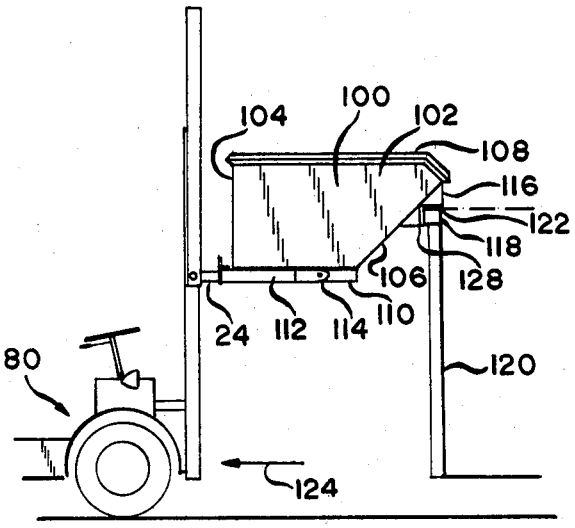
FIGS. 6 and 7 illustrate the dumping operation of the trash hopper of the invention; and, FIGS. 8, 9 and 10 are side, front and under surface views of the trash hopper of the invention.
Figure 7:
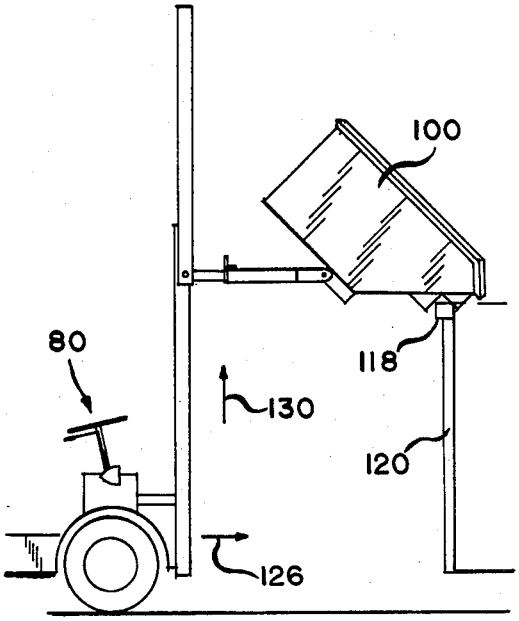

Referring now to FIGS. 6 and 7, the operation of a self-dumping trash hopper will be described. As shown in FIG. 7, the trash hopper 100 has rigid side walls 102, rear wall 104 and an inclined forward wall 106. The walls also have an upper peripheral reinforcement frame 108 which can be formed of an angle or of tubular stock. The bottom wall of the hopper is permanently mounted on a fore frame 110 which is pivotally attached to an aft frame 112 along hinge line 114. In the lifting and transport operations, the fork 24 of forklift 80 is inserted fully into the fore and aft frames thereby insuring against inadvertent tilting of the hopper 100. When the operator wishes to dump this hopper, the hopper is positioned with the step bracket 116 seated against the peripheral upper rail 118 of a large refuse box 120. In this position, an edge lip 122 of bracket 116 overhangs the frame 118 of box 120 and the lift operator can move the forklift 80 in the direction indicated by the arrowhead line 124, retracting the fork 24 sufficiently to clear the fore frame 110.

In most instances, the hooper will tilt when lifted with the fore frame cleared of the lift, dumping its contents into box 120. When the hopper is loaded with the contents sufficiently aft of the hinge line 114 that it doesn't tilt from its own weight, the lift operator can move the forklift forward slightly along arrowhead line 126 to engage lip 128 of bracket 116 beneath the peripheral upper frame 118 of box 120. The operator can then resume lifting the forklift, moving it along line 130. Since the forward end of the hopper 110 is restrained by lip 128, this movement results in tilting of the hopper 100 into the discharge position shown in FIG. 7. After discharging the contents of hopper 100, the lift operator lowers the lift fork, which returns the hopper to the position shown in FIG. 6 and then lifts the hopper slightly to clear the lip 122 from the upper frame 118 of box 120, freeing the hopper for return to its loading operation. Alternatively, the operator can simply lift the hopper until it clears box 120 and can then back away from box 120 and lower the hopper, in its tilted position to the ground where it returns to an upright position.

Figure 8:
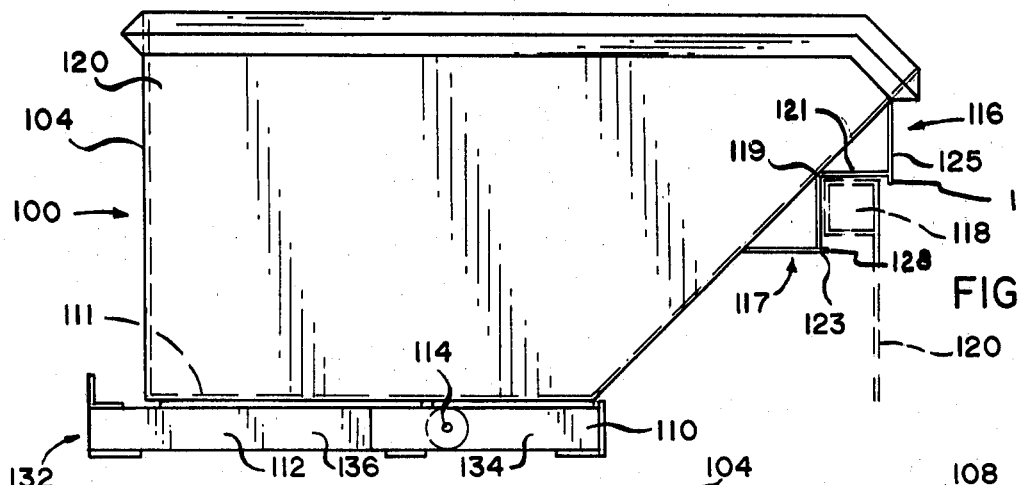
Figure 9:
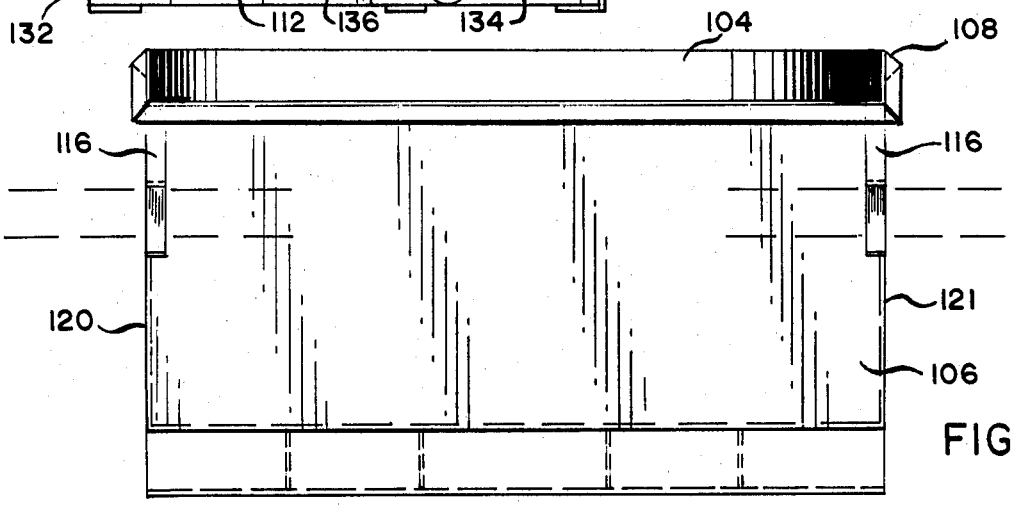
Figure 10:
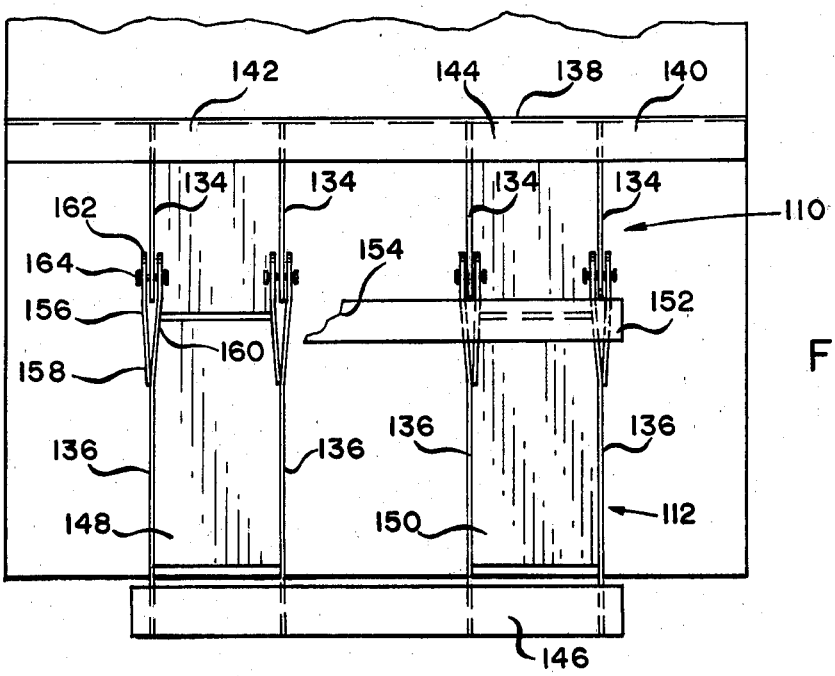

Referring now to FIGS. 8–10, the construction details of the trash hopper shown in FIGS. 6 and 7 will be described in greater detail.

The trash hopper 100 is shown with substantially parallel and spaced apart side walls 120 and 121, a vertical rear wall 104 and an inclined front wall 106. The angle of inclination of the front wall can be from 30 to about 60 degrees, preferably from about 45 degrees. Bottom wall 111 of the hopper completes the hopper inclosure and these walls are all fixedly and rigidly interconnected. An upper reinforcement frame peripherally encircles the hopper and this frame can be formed of tubular material, or as illustrated, of an angled member welded to the sheet metal sides of the hopper 100.

The forward wall 106 of hopper 100 has a pair of step brackets 116 and 117 laterally disposed thereto as shown in FIG. 9. These brackets are formed by a right angle strip 121 with its apex welded to the front wall 106 and supporting flat plates 123 and 125. The latter extend past the ends of the legs of right angle strip 121 thereby providing the aforementioned lips 122 and 128. The hopper 100 is shown in FIG. 8 in its relationship to the box 120 and its upper reinforcement rail 118 shown in phantom lines.

The hopper 100 is supported on a frame generally indicated at 132 and formed of a fore frame 110 which is pivotally carried by an aft frame 112 along the hinge line 114 formed by interconnecting pins described in greater detail in reference to FIG. 10. Each of the frames include a plurality of rails such as rails 134 of fore frame 110 and rails 136 of aft frame 112 which are pivotally interconnected.

Referring now to FIG. 10, the undersurface of the hopper is shown.

As there illustrated, the fore frame is formed by four parallel rails 134 which are permanently secured to the under surface of bottom wall 111 of hopper 100 by welding and the like. The forward end of these rails are interconnected by a vertical cross bar 138 and a horizontal cross bar 140 and the open space between the two sets of parallel rails 134 is enclosed by bottom plates 142 and 144.

Cross bars 140 and 138 extend across the entire width of the hopper so that when the hopper is lowered to ground level these crossbars serve as a blade for a bulldozing action.

The rails 136 of the aft frame are interconnected at their rear ends by horizontal cross bar 146 and, also, by horizontal plates 148 and 150 between adjacent parallel sets of rails 136.

The illustration of FIG. 10 shows also a cross bar 152 at the forward portions of rails 136 and this cross bar is broken away at 154 to reveal the details of the hinge construction interconnecting the fore and aft frames. Cross bars 152 reinforces the assembly and serves as a stop to limit the angle of tilt of the hopper.

The fore and aft frames are interconnected by a clevis construction wherein the forward portion 156 of each rail 136 is bent slightly at 158 and a short rail 160 is attached thereto by welding to form a slot 162 which receives the end of rail 134. The interspaced ends of these rails have aligned bores which receive hinge pins 164 in the form of bolts and the like.

The aforementioned construction provides a hopper which is freely pivotally mounted on an aft frame with spaced apart and parallel receptacles for receiving the arms of a lift fork. During the transport and lifting operations, the lift fork is fully inserted, received by both the fore and aft frames thereby locking the hopper against inadvertent tilting. The trash hopper can be readily tilted to discharge its contents into the coacting refuse box hopper by positioning the hopper with its step bracket resting on the upper reinforcement frame of the box hopper. In this position, the lips of the step bracket coact with the top rails of the box hopper to permit partial extraction of the forklift when the hopper is in the elevated position and to cause the hopper to tilt when it is lifted by its aft frame.

The hoppers of the invention provide complete operation by a single forklift operator without requiring the operator to dismount from the forklift. No manual latch mechanisms are employed and the entire operation is controlled using only the existing controls of the forklift. The positive interconnection of the trash hopper to the receiving box hopper insures that the operator can readily tilt the hopper to discharge its contents even when unbalanced loads are encountered since the interconnection of these hoppers results in a downward force at the forward end of the trash hopper when the latter is in position on the top rail of the box hopper and is lifted by its aft frame.

The invention has been described with reference to the illustrated and presently preferred embodiments. It is not intended that this description of the presently preferred embodiments be unduly limiting of the invention. Instead, it is intended that the invention be defined, by the means, and their obvious equivalents, set forth in the following claims.

What is claimed is:

1. A dump hopper for transfer of particulate solids to a receiving hopper which comprises:

vertical rear and generally parallel sidewalls and an inclined front wall fixedly secured to a bottom wall defining an open-top chamber to receive said solids;

subjacent frame means including a fore frame having a first plurality of rails of lengths less than the length of said bottom wall and fixedly secured to the forward undersurface of said bottom wall and an aft frame pivotally interconnected thereto and having a second plurality of rails, each pivotally interconnected to a respective one of said first plurality of rails along a hinge line intermediate the length of the bottom wall of said hopper, and interconnected by aft frame crossbar means;

first and second fork receptacle means on said fore and aft frame means, respectively, in alignment to receive a fork of a lift, immobilizing the pivotal interconnection of said fore and aft frame;

an open groove bracket carried on and laterally extending across the outside surface of said inclined front wall with coextensive lips along each edge thereof for engagement and coaction with the upper edge of said solids receiving hopper whereby said dump hopper can be fixedly engaged with the upper edge of said hopper to permit retraction of a fork from said first fork receptacle means, freeing the pivotal interconnection of said fore and aft frames, and permitting said hopper to tilt and dump its contents.

2. The dump hopper of claim 1 wherein said front wall is outwardly inclined at an angle from 30 to 60 degrees.

3. The dump hopper of claim 1 wherein said open groove bracket is a step bracket having an open right angle groove with lateral support plates along each of its edges.

4. The dump hopper of claim 1 including a reinforcement frame fixedly carried on the top peripheral edges of said hopper.

* * * * *